169-45 SR
12/23/86 OR 4,630,683

United States Patent [19]
Allan

[11] Patent Number: 4,630,683
[45] Date of Patent: Dec. 23, 1986

[54] AFTERBURNING REDUCTION

[75] Inventor: Barry D. Allan, Huntsville, Ala.

[73] Assignee: The United States of America as represented by the Secretary of the Army, Washington, D.C.

[21] Appl. No.: 801,023

[22] Filed: Nov. 22, 1985

[51] Int. Cl.[4] ..... A62C 1/14; A62C 1/18; A62C 3/08

[52] U.S. Cl. ..... 169/45; 60/264; 60/266; 60/39.5; 169/62; 239/265.17

[58] Field of Search ..... 60/39.5, 220, 253, 254, 60/264, 266; 239/265.11, 265.17; 169/45, 46, 62

[56] References Cited

U.S. PATENT DOCUMENTS

| | | | |
|---|---|---|---|
| 2,837,891 | 6/1958 | Stasiak | 60/254 UX |
| 3,815,360 | 6/1974 | Wellinitz | 239/265.17 X |
| 4,113,019 | 9/1978 | Sobolev et al. | 239/265.17 X |

*Primary Examiner*—Andres Kashnikow
*Attorney, Agent, or Firm*—Freddie M. Bush; James T. Deaton

[57] ABSTRACT

A method of reducing the visible flash caused from afterburning of a rocket motor by injecting a fire extinguishing suppressant material into the exhaust gases from the rocket motor and injecting the fire extinguishing suppressant material near the exhaust end of the rocket motor nozzle and about an internal periphery of the exhaust nozzle. An effective fire extinguisher suppressant includes fluoro halogenated carbon compounds and specifically $CBrF_3$.

3 Claims, 1 Drawing Figure

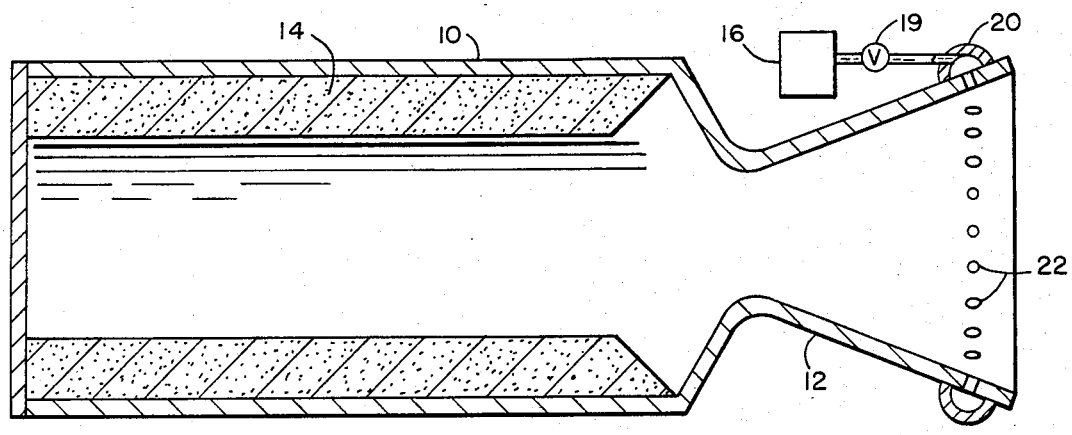
14
10
16
19
20
V
22
12

AFTERBURNING REDUCTION

DEDICATORY CLAUSE

The invention described herein may be manufactured, used, and licensed by or for the Government for governmental purposes without the payment to me of any royalties thereon.

BACKGROUND OF THE INVENTION

Current minimum smoke rocket motor solid propellants produce fuel rich exhaust products that combust or afterburn with air beyond the nozzle exit of the rocket motor. Such afterburning does not contribute to rocket motor thrust, is undesirable, and in many cases is unacceptable because it increases the radiation emission signature of the missile.

There are many documented approaches for the use of chemical means to suppress afterburning, however they have not been proven to be acceptable for accomplishing the desired results in afterburning for all cases. Depending upon the nature of the chemicals used, various previous methods have included: (1) the incorporation of the chemical suppressant into the main rocket motor propellant itself, (2) coating resonance rods with the chemical suppressant and placing them inside the rocket motor structure and (3) using ablative nozzle rings or sections in the rocket motor for providing suppressant for the rocket motor.

Many solid propellants that are used in these minimum smoke type solid propellants are chemically or otherwise incompatable with the suppressant so that direct incorporation into the minimum smoke solid propellant is not possible. In prior art devices, the ablative technique is ineffective and requires large amounts of suppressant that results in smoke signature. Therefore, it can be seen that a method or device that is effective in controlling or eliminating afterburning in a rocket motor is needed.

Accordingly, it is an object of this invention to provide a method of injecting a suppressant into the exhaust gases of a rocket motor to cause the exhaust gases to be substantially extinguished.

Another object of this invention is to provide a method in which a specific fluoro halogenated carbon compound is injected into the rocket motor exhaust gases to act as a fire extinguishing material to extinguish and prevent or reduce afterburning.

Still another object of this invention is to inject a halogenated carbon compound into the exhaust gases of a rocket motor to act as a fire extinguishing substance to reduce afterburning of the exhaust gases.

Other objects and advantages of this invention will be obvious to those skilled in this art.

SUMMARY OF THE INVENTION

In accordance with this invention, a fluoro halogenated carbon compound is injected into the exhaust gases of a rocket motor to provide a fire extinguishing substance into the exhaust gases to reduce and/or prevent afterburning of the exhaust gases from the rocket motor. A specific fluoro halogenated carbon compound that has been found to be effective in substantially reducing afterburning of the gases of a rocket motor is $CBrF_3$.

BRIEF DESCRIPTION OF THE DRAWING

The single FIGURE of the drawing is a schematic illustration of a rocket motor with injection means externally of the rocket motor for injecting a chemical fire extinguishing type suppressant into the exhaust gases of the rocket motor.

DESCRIPTION OF THE PREFERRED EMBODIMENT

This invention involves a method of injecting a fire extinguishing substance as a suppressant into the exhaust gases of a burning solid propellant rocket motor by injecting the fire extinguishing substance at the end of the rocket motor nozzle or along the expansion cone of the rocket motor nozzle so that the fire extinguisher material follows the contour of the plume and controls afterburning of the gases exhausting the rocket motor nozzle. A specific chemical used in this invention is $CBrF_3$ and other fluoro halogenated carbon compounds that have fire extinguishing characteristics.

Referring now to the single figure of the drawing, a rocket motor case 10 in accordance with this invention has an exhaust nozzle 12 with a minimum smoke solid propellant main motor charge 14 mounted in the chamber defined within rocket motor case 10. At the nozzle end of the rocket motor, a small tank or bladder arrangement 16 that is filled with a fire extinguisher and suppressant compound is provided and is connected by connection 18 and valve 19 to a ring 20 or other structure for dispersing the suppressant around the periphery of the rocket motor nozzle. Ports 22 communicate with the chamber of structure 20 for communicating the suppressant into the rocket motor gases exiting the rocket motor nozzle. Structure 20 and ports 22 can be at the end of nozzle 12 as illustrated or they can be placed inwardly from the exhaust end of the nozzle but along the expansion cone of the nozzle. The chemical suppressant and fire extinguisher substance that has been found to be most appropriate is $CBrF_3$ and this compound has been found to reduce the visible flash from about 50 to 100 percent depending upon the amount of the suppressant material injected into the exhaust gases. That is, as the amount injected is increased, the amount of visible flash is reduced In operation, solid propellant 14 is ignited in a conventional manner and exhaust gases exhaust through nozzle 12 as extinguishing suppressant material from container 16 is injected through ports 22 by opening valve 19 in a conventional manner to suppress and reduce visible flash of the exhaust from nozzle 12.

I claim:

1. A method of reducing the visible flash from the exhaust nozzle of a rocket motor comprising injecting a fire extinguishing suppressant of a fluoro halogenated carbon compound into exhausting exhaust gases just prior to their exhausting from the exhaust nozzle of a rocket motor that has a fast burning solid propellant burning therein to substantially reduce visible flash of the exhausting gases of said rocket motor as the exhaust gases are exhausted from said exhaust nozzle and into contact with oxygen in the atmosphere to effectively control visible flash and afterburning of the exhaust gases which are fuel rich.

2. A method as set forth in claim 1, wherein said fire extinguishing suppressant is $CBrF_3$.

3. A method as set forth in claim 2, further comprising injecting said fire extinguishing suppressant into the rocket motor nozzle near an exhaust end of the rocket motor nozzle and around the complete periphery at an internal surface of the exhaust nozzle of the rocket motor.

* * * * *